United States Patent [19]

Henricks

[11] Patent Number: 4,475,294

[45] Date of Patent: Oct. 9, 1984

[54] PROCESS FOR DRYING AND CURING WIRE INSULATION USING HEAT EXCHANGE AND APPARATUS THEREFOR

[76] Inventor: Charles G. Henricks, 1636 Bayview Dr., Muskegon, Mich. 49441

[21] Appl. No.: 286,729

[22] Filed: Jul. 27, 1981

[51] Int. Cl.[3] ..... F26B 13/02; F26B 23/00

[52] U.S. Cl. ..... 34/79; 34/86; 34/155; 34/216; 118/58; 118/61; 432/72; 432/223

[58] Field of Search ..... 34/23, 26, 28, 32, 35, 34/86, 79, 155, 210, 212, 216; 432/72, 223; 118/58, 61

[56] References Cited

U.S. PATENT DOCUMENTS

| | | | |
|---|---|---|---|
| 3,183,605 | 5/1965 | Argue et al. | 34/72 |
| 3,362,080 | 1/1968 | Daane | 34/86 |
| 3,909,953 | 10/1975 | Hemsath et al. | 34/32 |
| 4,094,627 | 6/1978 | Milton, Jr. | 432/72 |
| 4,326,344 | 4/1982 | Smith | 34/86 |

FOREIGN PATENT DOCUMENTS

| | | | |
|---|---|---|---|
| 2254848 | 5/1974 | Fed. Rep. of Germany | 34/79 |

*Primary Examiner*—Larry I. Schwartz
*Attorney, Agent, or Firm*—James G. Staples

[57] ABSTRACT

An energy efficient method of drying and curing insulation on wire, especially magnet wire, is disclosed. Heated gases are used separately to dry and cure a curable insulating coating such as a phenolic resin. Gases exhausted from the drying and curing operations and containing volatile combustible materials evolved from the drying and curing of the coating, is passed to a heat exchanger where they pick up heat from the exhaust gases of a fume burner. The hot gases are then passed to the fume burner where the combustible materials are burned to add heat of combustion to the gas stream, which is then cycled back as the fume burner exhaust through the heat exchanger, mixed with air, and passed to the drying section of the wire oven. This recapture of the heat from the combustion provides the heat needed for drying of the coating, thus maximizing the energy efficiency of the process. Apparatus to perform the process is also disclosed.

9 Claims, 1 Drawing Figure

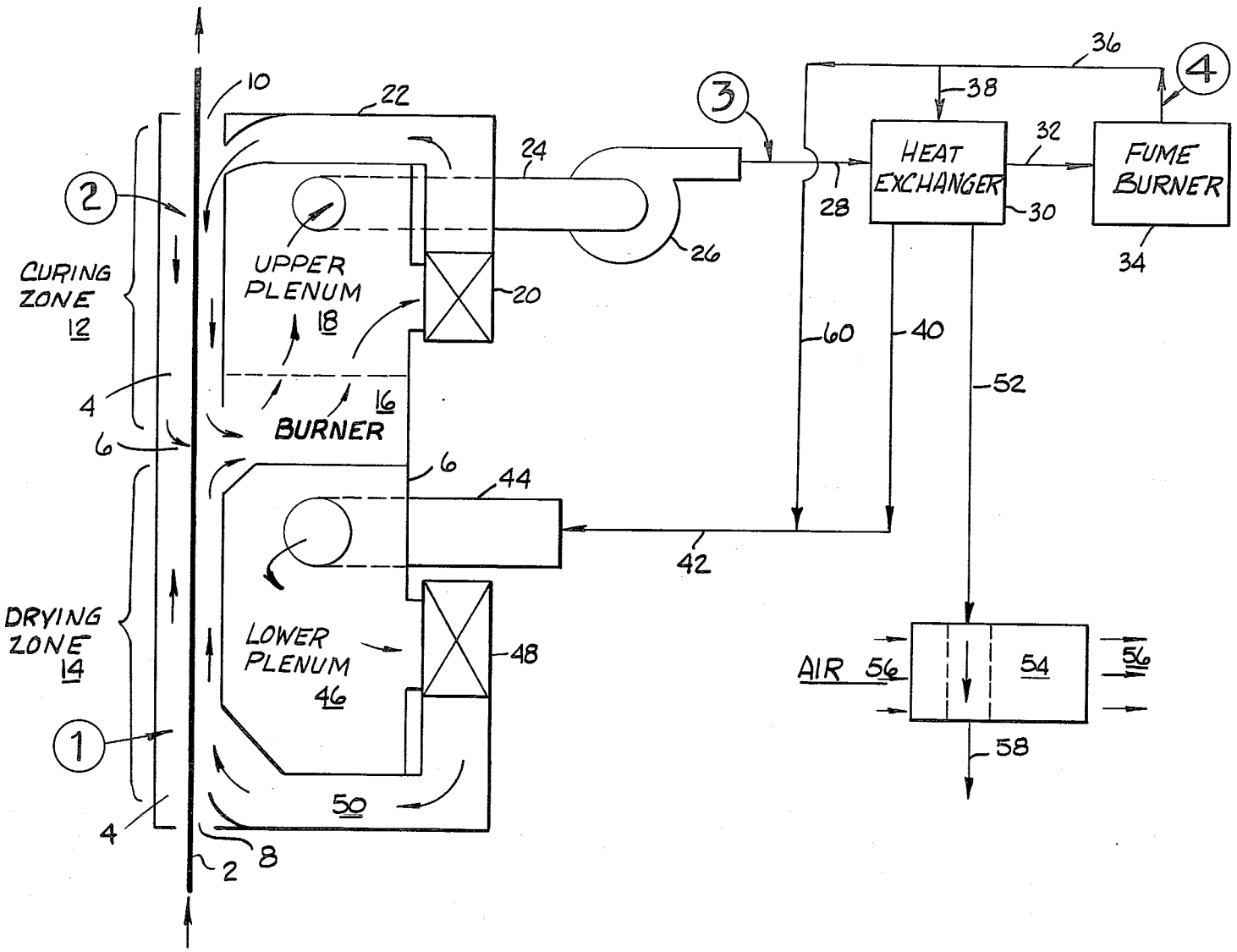
FUME BURNER
HEAT EXCHANGER
AIR
UPPER PLENUM
BURNER
LOWER PLENUM
CURING ZONE
DRYING ZONE

PROCESS FOR DRYING AND CURING WIRE INSULATION USING HEAT EXCHANGE AND APPARATUS THEREFOR

BACKGROUND OF THE INVENTION

The invention herein relates to processes for curing insulation on wire.

Various types of electrical wire, including particularly magnet wire, are insulated by coating thereon a layer of curable organic insulating material such as phenolic resin. The insulation is applied to the wire in a wet uncured form and thereafter must be passed through a drying step and a curing step to form the finished insulating coating on the wire.

In the past such drying and curing steps were considered to be distinct operations even though they might be performed in the same piece of equipment. Fuel usages were high because the drying air and the curing air were heated separately. The drying and curing air streams each picked up volatile combustible materials from the coating during the drying and curing operations, but the volatile combustible materials in each stream were separately burned in an external fume burner, with the resulting gases being vented directly to the atmosphere, so that all the sensible heat was lost. In view of this substantial energy loss, it would be desirable to have a process and associated equipment to enable that heat energy to be recovered for use in the wire coating operation.

SUMMARY OF THE INVENTION

The invention herein is a process for drying and curing the insulation on a wire, commonly a magnet wire, which provides for significant quantities of heat recovery and reduction in fuel usage as compared to conventional insulation drying and curing processes. The process of this invention comprises (a) having a drying zone and a curing zone through which the wire having the curable insulating material coated thereon passes sequentially;

(b) passing separate air streams through the respective zones to effect drying and curing respectively, with volatile combustible materials being evolved from the curable insulating material and mixed into said air streams;

(c) passing said air streams containing said volatile combustible materials from said zones through the cold side of a high temperature heat exchanger, wherein they receive heat transferred from a fume burner combustion gas stream at a higher temperature;

(d) passing the heated air streams containing volatile combustible materials from said high temperature heat exchanger to a fume burner wherein said volatile combustible materials are burned to form said combustion gas stream; and (e) passing said combustion gas stream through the hot side of said high temperature heat exchanger, wherein it transfers sensible heat to said air streams containing volatile combustible materials, and then on to said drying zone wherein it is mixed with air to effect drying of said curable insulating material.

In a preferred embodiment, the process comprises:

(a) having a drying zone and a curing zone through which the wire having the curable insulating material coated thereon passes sequentially;

(b) passing a first gaseous stream containing air and non-combustible gases through said drying zone in contact with said wire, with the temperature of said stream being such as to effect drying but not curing of the curable insulating material, said stream also simultaneously accumulating therein combustible volatile gases which are evolved from said curable insulating material during said drying;

(c) passing said first stream containing air, non-combustible gases and combustible gases through a first burner wherein said stream is heated to a temperature above the curing temperature of the curable insulating material;

(d) dividing said first stream into a second gaseous stream and a third gaseous stream;

(e) passing said second stream through said curing zone in contact with said wire, with said second stream effecting the cure of said curable insulating material, and then returning said second stream to said first burner;

(f) passing said third stream through the cold side of a high temperature heat exchanger wherein sensible heat is transferred to said third stream from a fourth gaseous stream having a higher temperature;

(g) passing said heated third stream to a second burner wherein said combustible gases are burned in the presence of air to form additional non-combustible gases, with the exhaust of said second burner being said fourth stream containing air and non-combustible gases and being further heated by the evolved heat of combustion during said burning, which fourth stream is then passed through the hot side of said high temperature heat exchanger to transfer sensible heat to said third stream; and (h) thereafter passing said fourth stream to said drying zone and mixing it with air to form said first stream.

In another preferred embodiment of the invention a portion of the cooled fourth stream exhausting from the high temperature heat exchanger may be separated from the main fourth stream and passed to a low temperature heat exchanger where it transfers more of its sensible heat to a space heating airstream, with the heated space heating airstream then being used to heat personnel workspaces in the vicinity of the process.

The invention also includes apparatus for the drying and curing of curable insulating material on a moving wire, which apparatus comprises (a) a wire insulation curing unit having therein heated drying and curing zones through which a wire having coated thereon a curable insulating material passes seriatim, wherein said wire is contacted with heated air to effect drying and curing of said curable insulating material in the respective zones and from which are exhausted air streams containing volatile combustible materials evolved from the curable insulating material during such drying and curing;

(b) a high temperature heat exchanger and means for passing said exhaust air streams from said drying and curing zones through the cold side of said high temperature heat exchanger;

(c) a fume burner and means for passing said exhaust air streams from said high temperature heat exchanger into said fume burner wherein said volatile combustible materials in said exhaust air streams are burned;

(d) means for passing the combustion gases exhausted from said fume burner through the hot side of said high temperature heat exchanger wherein said combustion gases transfer sensible heat to said exhaust air streams; and (e) means for passing said combustion gases from said high temperature heat exchanger to said drying zone and in said means mixing said combustion gases with air and using the mixture to effect drying of said curable insulating material.

In a preferred embodiment the apparatus comprises:

(a) a wire insulation curing unit having therein a heated passage divided into a drying zone and a curing zone through which the wire with the curable insulating material passes and contacts a heated first gaseous stream in said drying zone and a heated second gaseous stream in said curing zone, with the temperature being maintained at at least the curing temperature of the insulating material in said curing zone and the temperature in said drying zone being maintained at a lower level;

(b) a first burner receiving a combined gaseous stream from said curing zone and said drying zone and being adapted to raise the temperature of the combined stream to at least the curing temperature of the insulating material;

(c) means for passing a second gaseous stream portion of the heated combined stream from said first burner to said curing zone;

(d) a high temperature heat exchanger and means for passing the remainder of said heated combined stream as a third gaseous stream from said first burner through the cold side of said high temperature heat exchanger to a second burner;

(e) said second burner, which is adapted to further heat said third stream and burn any volatile organic materials which may be entrained therein;

(f) and means for passing the exhaust of said second burner as a fourth gaseous stream from said second burner through the hot side of said high temperature heat exchanger and to said drying zone and mixing said fourth stream with air to form said first stream; thereby utilizing the sensible heat from the combustion of volatile combustible materials to provide the heat needed to dry the wet uncured insulation in the drying zone.

In another preferred embodiment of the apparatus, the apparatus also comprises a low temperature heat exchanger and means for diverting a portion of the fourth stream passing through the hot side of the high temperature heat exchanger to the low temperature heat exchanger, as well as means to provide airflow through the cold side of said low temperature heat exchanger to be heated and utilized as space heating air.

BRIEF DESCRIPTION OF THE DRAWING

The single FIGURE of the drawing schematically shows the process of this invention and the principal components of the apparatus. The circled boldface numbers identify the designated gas streams discussed below.

DETAILED DESCRIPTION AND PREFERRED EMBODIMENTS

The process and apparatus of this invention are best understood by reference to the drawing, which shows the invention in the context of a preferred overall wire insulation drying and curing operation.

A wire 2 having coated thereon an insulating material in wet form which is capable of being solidified by curing is first dryed and then cured by being passed through a heated passage 4 in a wire curing furnace 6. The wire with the wet uncured insulating coating enters at the incoming end 8 of the passage 4 and emerges at the outgoing end 10 of the passage 4 with the insulation in a dry fully cured solid state. The curable insulating material is normally an organic material which cures by polymerization such as a phenolic resin. For brevity herein the curable coating will be referred to as a resin. It will be evident from the description herein, however, that this process is not limited to any specific insulating material, but can be used with any type of insulating material which can be applied as a wet coating and then dried and cured by heating to form a solid insulating coating on the wire and which evolves volatile combustible materials while drying or curing. ("Curing" as used herein means any form of heat induced solidification, including but not limited to addition or condensation polymerization, crosslinking or vulcanization.)

In the schematic diagram shown, only a single wire 2 is illustrated. It will be understood, however, that in a normal wire curing furnace, the passage 4 is in the form of a elongated slot with a substantial number of individual wires traveling through the passage in a parallel array. In the FIGURE as shown, this array would extend into the plane of the FIGURE. For the purpose of brevity in this application, the invention will be described with respect to the curing of the insulated coating on a single wire; it will be understood, however, that the process is not limited to curing only a single wire at a time but can be used to cure many coated wires simultaneously.

The passage 4 is divided into two contiguous zones, a curing zone 12 and a drying zone 14. These are aligned so that a given portion of the wire passes successively through the drying zone and then through the curing zone before exiting from the passage 4. In the drying zone 14 the temperature of the gaseous stream (the "first" gaseous stream, containing air and non-combustible gases) is controlled at about 450° F. (230° C.) in order to dry the liquid resin and drive off the volatile combustible materials in the resin (which then accumulate in the first gaseous stream). As will be described below, these volatile materials normally (organic compounds) will subsequently be burned and their heat of combustion used to provide sensible heat to the air. The actual temperature in the drying zone is not critical, but will be determined as the optimum temperature for drying the particular resin which is being used for the insulating coating. Such optimum drying temperatures are already known for many insulations, and will not differ significantly in this process from the drying temperatures used in prior art processes.

After drying the coated wire continues on and travels through the curing zone 12. In this zone the dried resin is cured at high temperatures, commonly by condensation polymerization reactions or crosslinking polymerization reactions, depending on the particular resin being used. Typically, the temperature in curing zone is on the order of 850° F. (450° C.). The temperature, however, is not critical and will be selected based on the known curing temperature of the particular resin involved. It is common practice to maintain the temperature in the curing zone somewhat above the minimum curing temperature required for the resin, to insure that the wire coating is thoroughly cured during the passage through the curing zone and to insure that even with normal heat losses from the zone the temperature throughout remains above the minimum curing temperature of the resin. The temperature must not be so high, however, that the resin becomes burned, scorched or otherwise degraded or decomposed. Additional volatile combustible materials may be given off by the coating in this zone, either as a result of the curing reaction or because of residual drying not fully accomplished in the drying zone.

In the preferred embodiment of this invention shown in the FIGURE the principal addition of heat to the combined gaseous streams occurs in first burner 16. This is a conventional hot air burner utilizing liquid or gaseous fuel. The gases passing through the burner are heated to at least the curing temperature of the resin coating, and preferably somewhat above that temperature. While in this preferred embodiment the burner 16 supplies heat to both the curing and drying zones (the latter indirectly after passage of the gases through the heat exchanger and fume burner), it will be understood that the basic feature of the invention herein involves the use of the heat exchanger and that the initial heating of the gases need not be combined as in burner 16 but may be by separate heating means.

The heated gases leaving the burner 16 pass into a plenum 18 (designated here the "upper plenum" because in most wire treating furnaces where the wire passes vertically through the furnace this plenum is at the upper portion of the furnace). In the upper plenum 18 the incoming gas stream (which is a combined stream formed of the "first" stream exhausting from the drying zone and the "second" stream exhausting from the curing zone) is divided into two portions. One portion (the "second" gaseous stream) is directed through fan 20 and conduit 22 to curing zone 12 as indicated by the arrows. In the curing zone 12 the gases travel countercurrently to the wire and effect the curing of the resinous insulating coating as described above. The gases exhausting from the curing zone are recirculated to burner 16 for reheating.

The remaining portion of the heated gases in upper plenum 18 (the "third" gaseous stream) is removed from upper plenum 18 through conduit 24 by blower 26 and passed through conduit 28 to a heat exchanger 30 (referred to herein as the "high temperature" heat exchanger). These gases pass through the "cold" side of heat exchanger 30, gaining sensible heat from the gaseous stream (the "fourth" gaseous stream) passing through the "hot" side as will be described below. Typically the amount of heat gained by the third gas stream is on the order of about 350° F. (175° C.) although the exact temperature increase is not critical and will be largely dependent upon the amount of combustible material in the third gas stream which is subsequently burned to create the hot side fourth stream.

After gaining sensible heat in the heat exchanger 30 the gas stream (containing air, some inert materials and the combustible volatile materials) is passed through conduit 32 to fume burner 34 in which all of the combustible volatile materials are burned to create heat of combustion and form additional inert gases in the gas stream. These high temperature gases leave the fume burner 34 (as the "fourth" gaseous stream) through conduit 36 at a temperature on the order of 1400° F. (760° C.) and are normally directed back through the hot side of heat exchanger 30 through conduit 38 where they give up a portion of their sensible heat to the incoming third gas stream from the plenum 18 as described. Thus by utilizing the heat exchange function in this process, the temperature of the volatile combustible materials can be brought to a point such that the addition of air in the fume burner 34 readily burns them and creates a substantial quantity of heat of combustion. This heat exchange function also provides a largely gas stream which is subsequently mixed with air for drying of the resin at an appropriate temperature without the need to provide additional heat input to the drying zone. The use of the high temperature heat exchange step in this process, therefore, makes the process significantly more efficient than prior art processes in which the exhaust gases from the curing and drying zones were either vented or burned without heat exchange or heat recovery.

It has been found that the process operates in a very satisfactory manner when the heat exchanger 30 is an "energy recovery unit" sold commercially under the trademark "Z-Duct" by DesChamps Laboratories Incorporated, model No. 1000 68A6. This particular commercial device is the most efficient unit known to the inventor herein for this application.

After giving up a significant quantity of its sensible heat the gas stream is passed out of the hot side of heat exchanger 30 through conduits 40, 42 and 44 into a second plenum 46 (frequently referred as the "lower plenum"), wherein it is mixed with cooler air to obtain the desired temperature for the drying step. The mixed air/gas streams is then passed by fan 48 through conduit 50 to drying zone 14. The process thus results in a virtually complete recapture of the heat needed for drying by means of the recycle and heat exchange functions of the process.

Control of the temperature within the curing zone 12 may be maintained by control of the combustion process in burner 16, in a conventional manner, such as control of fuel supply rate. Control of the temperature in drying zone 14 can be by control of the amount of the fourth gas stream passed through the hot side of heat exchanger 30 (as compared to that by-passed as described below), by control of the amount of air of a given temperature mixed with that gas stream in lower plenum 46, or both. Other control means may also be used for temperature control in either or both zones as desired.

A portion of the fourth gas stream from the hot side of heat exchanger 30 may be drawn off through conduit 52 to the hot side of a second ("low temperature") heat exchanger 54 where it gives up sensible heat to room or ventilating air 56 which is passing through the cold side of the heat exchanger. The ventilating air 56 when thus heated can be used for space heating purposes, commonly in the vicinity of the wire insulation curing operation. Thus this feature can be used to heat the interior of the building in which the operation is housed and/or the interiors of neighboring buildings. This added feature allows for further utilization of the sensible heat from the process and further reduces the amount of energy used since no added energy is needed to provide such space heating. After transfer of the heat in the second heat exchanger 54 the gas stream is exhausted through conduit 58 usually to a stack (not shown) for dispersal in the atmosphere.

Draw off of this portion of the fourth gas stream through line 52 also serves the function of controlling the concentration of non-combustible materials cycling through the system at any given time.

If desired a portion of the fourth gas stream from the fume burner 34 can be diverted around heat exchanger 30 through conduit 60 if a higher temperature in the drying zone is desired and the heat transfer in heat exchanger 30 would be too great to maintain this higher temperature of the exit gases. This is also a means of controlling the temperature of the third gas stream in conduit 32 entering the fume burner 34.

It will be evident that the invention described herein can be employed in a number of different embodiments, all within the scope and spirit of the invention. Consequently, the description above is intended to be exemplary only and the invention is to be defined solely by the claims appended hereto.

What is claimed is:

1. A process for drying and curing the insulation on a wire which comprises:

(a) having a drying zone and a curing zone through which the wire having the curable insulating material coated thereon passes sequentially;

(b) passing a first gaseous stream containing air and non-combustible gases through said drying zone in contact with said wire, with the temperature of said stream being such as to effect drying but not curing of the curable insulating material, said stream also simultaneously accumulating therein combustible volatile gases which are evolved from said curable insulating material during said drying;

(c) passing said first stream containing air, non-combustible gases and combustible gases through a first burner wherein said stream is heated to a temperature above the curing temperature of the curable insulating material;

(d) dividing said first stream into a second gaseous stream and a third gaseous stream;

(e) passing said second stream through said curing zone in contact with said wire, with said second stream effecting the cure of said curable insulating material, and then returning said second stream to said first burner;

(f) passing said third stream through the cold side of a high temperature heat exchanger wherein sensible heat is transferred to said third stream from a fourth gaseous stream having a higher temperature;

(g) passing said heated third stream to a second burner wherein said combustible gases are burned in the presence of air to form additional non-combustible gases, with the exhaust of said second burner being said fourth stream containing air and non-combustible gases and being further heated by the evolved heat of combustion during said burning, which fourth stream is then passed through the hot side of said high temperature heat exchanger to transfer sensible heat to said third stream; and (h) thereafter passing said fourth stream to said drying zone and mixing it with air to form said first stream.

2. A process as in claim 1 wherein the temperature in said curing zone is maintained at about 850° F. and the temperature in said drying zone is maintained at about 450° F.

3. A process as in claim 2 wherein the inlet temperature of said third gaseous stream to said high temperature heat exchanger is on the order of 850° F., its temperature at the inlet of said fume burner is on the order of 1200° F. and the temperature of said fourth gaseous stream exhausting from said fume burner is on the order of 1400° F.

4. A process as in claim 1 wherein said fourth gaseous stream exiting from said high temperature heat exchanger is divided, with a first portion passing to said drying zone and a second portion passing to a low temperature heat exchanger wherein it transfers sensible heat to an ambient air stream.

5. A process as in claim 1 wherein a portion of the gas stream exhausting from said fume burner is diverted around said high temperature heat exchanger and passed to said drying zone without passing through said hot side of said heat exchanger.

6. Apparatus for the drying and curing of curable insulating material on a moving wire, which comprises:

(a) a wire insulation curing unit having therein a heated passage divided into a drying zone and a curing zone through which the wire with the curable insulating material passes, said wire contacting (1) a heated first gaseous stream in said drying zone and (2) a heated second gaseous stream in said curing zone, the temperature in said curing zone being maintained at at least the curing temperature of the insulating material and below the degradation or decomposition temperature for the insulating material and the temperature in said drying zone being maintained at a level lower than in said curing zone;

(b) a first burner for receiving a combined gaseous stream from both said curing zone and said drying zone and providing heat to raise the temperature of the combined stream to at least the curing temperature of the insulating material;

(c) means for passing a first portion of said heated combined gaseous stream from said first burner to said curing zone;

(d) a high temperature heat exchanger having a hot side and a cold side and means for passing a second portion of said heated combined gaseous stream as a third gaseous stream from said first burner through the cold side of said high temperature heat exchanger;

(e) a fume burner, communicating with the cold side of said high temperature heat exchanger, providing heat to further raise the temperature of said third gaseous stream and burning any volatile organic materials which may be entrained therein;

(f) means for passing the exhaust of said fume burner as a fourth gaseous stream from said fume burner through the hot side of said high temperature heat exchanger and to said drying zone and for mixing said fourth gaseous stream with air to form said first gaseous stream; thereby utilizing the sensible heat from the combustion of volatile combustible materials to provide at least a portion of the heat needed to dry the wet, uncured insulating material in the drying zone.

7. Apparatus as in claim 6 further comprising, (g) a low temperature heat exchanger in communication with the hot side of said high temperature heat exchanger;

(h) dividing means for separating said fourth gaseous stream into two portions after said forth gaseous stream exists from said high temperature heat exchanger and means for passing a portion of said fourth gaseous stream to a low temperature heat exchanger; and (i) said low temperature heat exchanger transferring sensible heat from said portion of said fourth gaseous stream to ambient air.

8. Apparatus as in claim 6 including means to control the amount of said fourth gaseous stream passing through said hot side of said high temperature heat exchanger, the amount of air to be mixed with said fourth gaseous stream passing to said drying zone from said high temperature heat exchanger, or both, thereby controlling the temperature within said drying zone.

9. Apparatus as in claim 6 further comprising means for diverting a portion of said exhaust expelled from said fume burner from said hot side of said high temperature heat exchanger and passing the diverted portion to said drying zone.

* * * * *